US005465239A

United States Patent [19]

Koch

[11] Patent Number: 5,465,239

[45] Date of Patent: Nov. 7, 1995

[54] ANALOGUE DISPLAY TIMEPLACE ABLE TO PROVIDE ALPHANUMERICAL INFORMATION CONCERNING THE STATE OF AN OPERATION MODE OR OF A PROGRAMMED EVENT

[75] Inventor: Daniel Koch, Crémines, Switzerland

[73] Assignee: ETA SA Fabriques D'Ebauches, Grenchen, Switzerland

[21] Appl. No.: 303,460

[22] Filed: Sep. 9, 1994

[30] Foreign Application Priority Data

Sep. 16, 1993 [CH] Switzerland ..... 02790/93

[51] Int. Cl.[6] ..... G04B 23/02; G04B 19/04

[52] U.S. Cl. ..... 368/72; 368/80; 368/228

[58] Field of Search ..... 368/76, 80, 223, 368/228, 238, 72–74

[56] References Cited

U.S. PATENT DOCUMENTS

| | | |
|---|---|---|
| 1,370,307 | 3/1921 | Gross . |
| 3,358,437 | 12/1967 | Burg . |
| 3,763,648 | 10/1979 | Pakter et al. . |
| 3,777,475 | 12/1973 | Grossan . |
| 4,314,146 | 2/1982 | Berney . |
| 5,224,078 | 6/1993 | Mallin . |

FOREIGN PATENT DOCUMENTS

| | | |
|---|---|---|
| 2442433 | 6/1980 | France . |
| 1493926 | 10/1940 | Germany . |
| 9111535.3 | 11/1991 | Germany . |
| 668156 | 12/1988 | Switzerland . |
| 2240410 | 7/1991 | United Kingdom . |

*Primary Examiner*—Vit W. Miska

*Attorney, Agent, or Firm*—Pollock, Vande Sande & Priddy

[57] ABSTRACT

An analogue display timepiece having at least one operation mode, time-related or non time-related, and able to provide information relating to the state of this mode and/or the state of a programmed event linked to the latter. The timepiece includes at least two analogue display organs providing an hour hand (H) and a minute hand (MN), an electronic control (22) to control the operation mode, and a display arrangement capable of providing the user with at least one alphanumerical message informing him of the state of the mode and/or the state of the event. The state display arrangement is formed by the hands (H, MN) themselves which, as a function of their relative angular position driven under the control of the electronic control (22), can act structurally upon the message to make it intelligible in the selected angular position of the hands.

20 Claims, 7 Drawing Sheets

CORRECTION HEURE
MODE HORAIRE

Pression
Pression
T1
Tige tirée
MODE ALARME PROGRAMMATION 2 sec.
CORRECTION POSITION DE L'AFFICHAGE DU MESSAGE D'ALARME
ETAT DE L'ALARME
Pression = Changement ON ⇄ OFF
ON
3sec
3 sec.

CORRECTION HEURE DE L'ALARME
HEURE DE L'ALARME
ON
5 sec.
Repousser

MODE ALARME FONCTIONNEMENT
Pression
ON
2 sec

ANALOGUE DISPLAY TIMEPLACE ABLE TO PROVIDE ALPHANUMERICAL INFORMATION CONCERNING THE STATE OF AN OPERATION MODE OR OF A PROGRAMMED EVENT

FIELD OF THE INVENTION

The present invention concerns an analogue display timepiece able to provide alphanumerical information relating to the state of an operation mode of the timepiece and/or the state of a programmed event, linked to this operation mode.

BACKGROUND OF THE INVENTION

More particularly the invention relates to a timepiece with an analogue essentially display, that is to say whose display means is formed by at least two hands comprising respectively an hour and a minute hand, and which may comprise, in conjunction with conventional operation modes, time-related or non time-related, an operation mode, called the alarm mode, in which, after programing, the timepiece can inform the user of the expiry of a lapse of time, by the transmission of at least one alphanumerical message.

In the application which will be described below, the operation mode called "alarm" mode means the transition to a specified unit of time, for example a meeting time, a day not to be forgotten corresponding for example to a birthday, or to a combination of units of these two time scales.

The programmed event may thus be an hour, a date or any other moment in time, which is anticipated at a precise moment, and of whose advent which one wishes to be informed by a clear message at the very moment of its advent, possibly several times, in a repetitive manner, until effective receipt of this information has been acknowledged.

Alarm time is thus understood here to mean a unit of time, without limitation, preferably programmed by the user, via special manipulation procedures.

The present invention also concerns a timepiece able to display, either in conjunction with the above-mentioned display of events or separately, information relating to the state of one of its operation modes, for example, the on or off indicators.

Conventional timepieces which enable data such as those mentioned above to be displayed, generally comprise a digital display device provided by a liquid crystal cell, whose structure enables a message in alphanumerical form to be provided, by the selection of a certain number of electrodes, structured inside the cell.

This type of liquid crystal display may be combined with an analogue hand display to provide, in addition to conventional time information, the desired alphanumerical data.

It is understood, however, that this arrangement is sophisticated and that it entails increases in the production costs of the timepieces which are equipped with it, as well as additional consumption of the power available, which is required for the creation and maintaining of the message in the cell.

Other conventional timepieces also enable information concerning states of the type mentioned above to be displayed, by the intermediary of one or more discs able to be moved, under the control of an electronic control circuit.

This arrangement is also costly as it requires installation of the disc or discs, as well as a particular cut of the dial. It also requires the provision of additional gears with corresponding power points where the driving motors are.

SUMMARY OF THE INVENTION

Thus, a purpose of the present invention is to overcome the above-mentioned disadvantages by providing an analogue timepiece of a simple, reliable and inexpensive construction, capable of providing the user with one or more alphanumerical messages informing him of the state of one or a plurality of operation modes of the timepiece and/or of an event.

Another purpose of the invention is to provide a timepiece of the type mentioned above in which the alphanumeric message display does not cause, at least when the message is displayed, any additional power consumption, even over relatively long display periods of this message.

BRIEF DESCRIPTION OF THE DRAWINGS

Other characteristics and advantages of the invention will become clear upon reading the following detailed description, made with reference to the attached drawings which are given here purely by way of illustrative example, and in which.

DETAILED DESCRIPTION OF THE INVENTION

Figure 1:
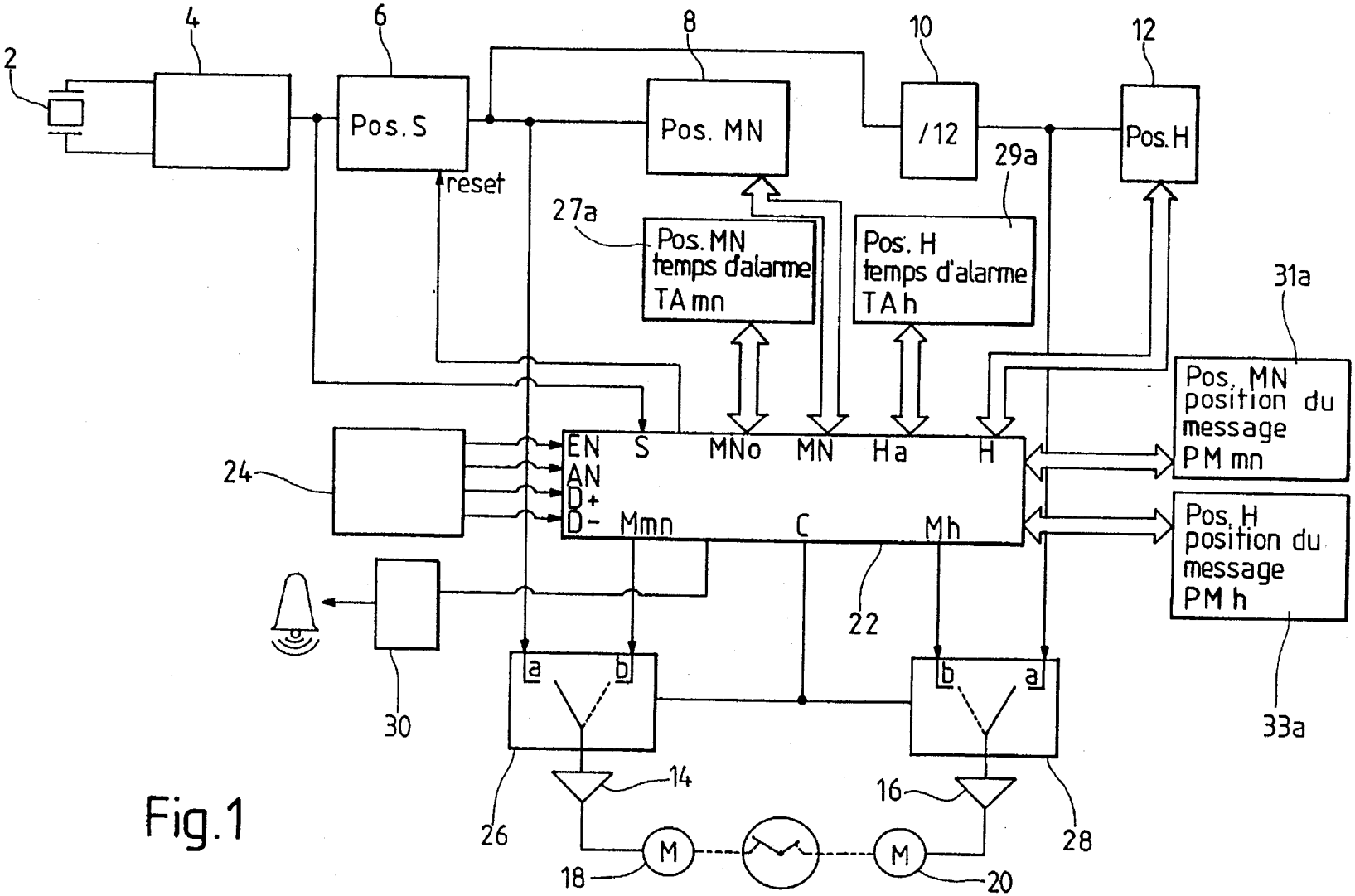
FIGS. 1 and 3 show in the form of a block diagram a watch called "alarm" watch according to a first and second embodiment of the present invention.

FIG. 1 shows, in the form of a block diagram, a timepiece, for example a watch, having a specific operation mode, called the alarm mode, and constituting an embodiment of the present invention. This timepiece may, in this embodiment, provide the user with information relating to when an event occurs or as to the state of the operation itself of this operation mode, this information being provided in the form of an alphanumerical message, the composition of which is made intelligible by hands which will be described below.

This timepiece comprises, in series, a quartz oscillator 2, a division chain 4 supplying a signal of 1 Hz, a second hand position counter referenced 6, and a minute hand position counter, referenced 8.

It also comprises a divider-by-twelve referenced 10, receiving a signal from second hand position counter and an hour hand position counter referenced 12 whose input is connected to the output of divider 10. Counters 6, 8 and 12 are counters-by-sixty whose operation mode is shown schematically in FIG. 2.

Figure 2:
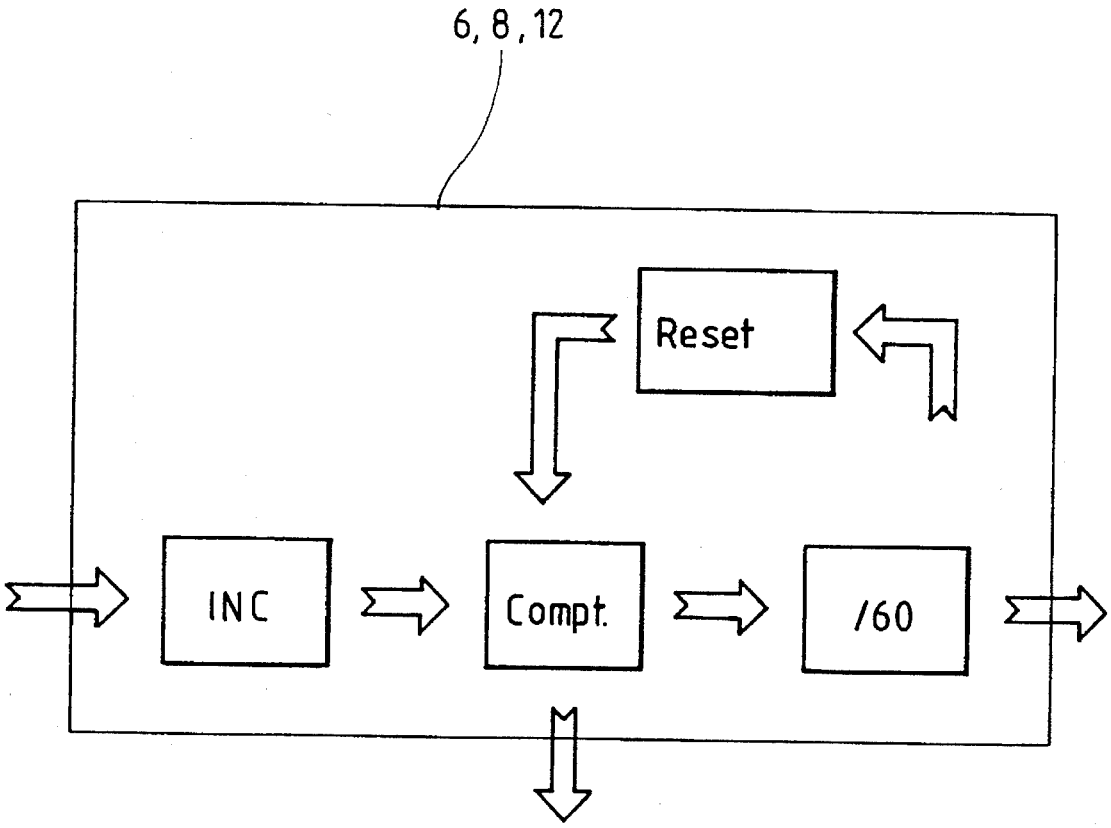
FIG. 2 is an operation diagram of a position counter, of the type of those incorporated in the diagrams of FIGS. 1 and 3, FIGS. 4 to 7 are top views of two hands, respectively of the hour and minute, incorporated in a timepiece according to the invention, and showing four different embodiments of these hands shown in two positions (A) and (B) corresponding respectively to any time display position and to an alphanumerical message display position.

As can be seen in FIG. 2, the pulses to be counted are provided to the counters (arrow on the far right in the drawing). These successive pulses are counted by a binary register of at least six bits, which they increment. The state of this register can be read at any time (arrow towards the bottom of the drawing). At each incrementation, the register is tested to see whether the number which it contains equals sixty. If this is the case, a pulse is emitted by the test circuit and this pulse causes the register to be reset at zero. The test circuit thus consists of a divider-by-sixty whose signal can be transmitted to another counter (arrow on the right in the drawing), which is the case of counters 6 and 8. Counter 12 may also provide this signal if other counters, of the day or month, are used with it.

Counters 8 and 12 (FIG. 1) define, in usual operation mode, namely in standard time display mode, the position, defined in sixty steps, of the minute and hour hands in relation to the timepiece hour-circle. As the watch described here does not include a second hand, the second hand position counter is used solely to generate a signal whose frequency enables the other counters 8 and 12 to be incremented in an appropriate manner.

The timepiece is also provided with two motors 18 and 20 able to be controlled independently by driving circuits 14 and 16 to drive respectively minute hand MN and hour hand H (FIGS. 4 to 10). Circuits 14 and 16 receive, in standard time mode, pulses applied respectively to the inputs of minute hand position counter 8 and hour hand position counter 12.

The arrangement of the motors and the gears of the present timepiece will not be described here. Clockwork movements comprising several motors to activate hands individually are already known. Patent EP-0 393 606 in particular discloses a clockwork movement comprising two motors capable of independently driving the minute and hour hands.

The alarm watch elements, shown in the block diagram of figure 1, which have just been described, explain the essentially analogue operation of this timepiece for the standard time display. However, according to the present invention, the analogue watch described here may also display information in the form of alphanumerical messages, in connection with the arrival at its term, defined as the advent, of a unit of time.

The elements of FIG. 1 which will now be described, enable, on the one hand, the display of additional state alphanumerical information to be achieved, and on the other hand, the hands to be reset to the exact time display position when this proves necessary.

As can be seen in FIG. 1, the timepiece comprises electronic control means 22 to enable it to fulfill various display functions and a function called the "alarm" function. Electronic control means 22 comprises inputs MN and H to receive the contents of minute hand position counter 8 and hour hand position counter 12, two activation inputs AN, EN and two inputs $D^+$, $D^-$ for the displacement data of the hands respectively forwards and backwards.

The signals applied to inputs AN, EN, $D^+$ and $D^-$ are provided by a circuit 24 for interpreting the position and displacement of the control stem. The operation of the control stem and interpreting circuit 24 will not be described in detail here because a man skilled in the art will already know devices of this type. Patent EP 0 175 961, in particular, discloses a control stem associated with an interpreting circuit which could easily be adapted to be used with the timepiece presently being described.

Electronic control means 22 also includes two outputs Mmn and Mh to supply pulses to motors 18 and 20, and a control output C to control the state of two switches 26, 28 placed at the entry to driving circuits 14, 16 and arranged to transmit to them, either the pulses applied to the inputs of minute hand position counter 8 and hour hand position counter 12 when the switches are in a first position referenced a, or the pulses supplied by electronic control means 22, when the switches are in a second position referenced b.

Electronic control means 22 may be advantageously produced in the form of an integrated circuit comprising a programmed micro-controller. A man skilled in the art will know, from the information provided here, how to carry out the programming of the micro-controller, to enable it to carry out the functions described here.

In standard time display mode, the electronic control means are inactive and motors 18 and 20 receive the pulses applied to the inputs of minute and hour hand position counters 8 and 12.

Figures 10A, 10B, 10C, 10D, 10E, 10F, 10G, 10H:
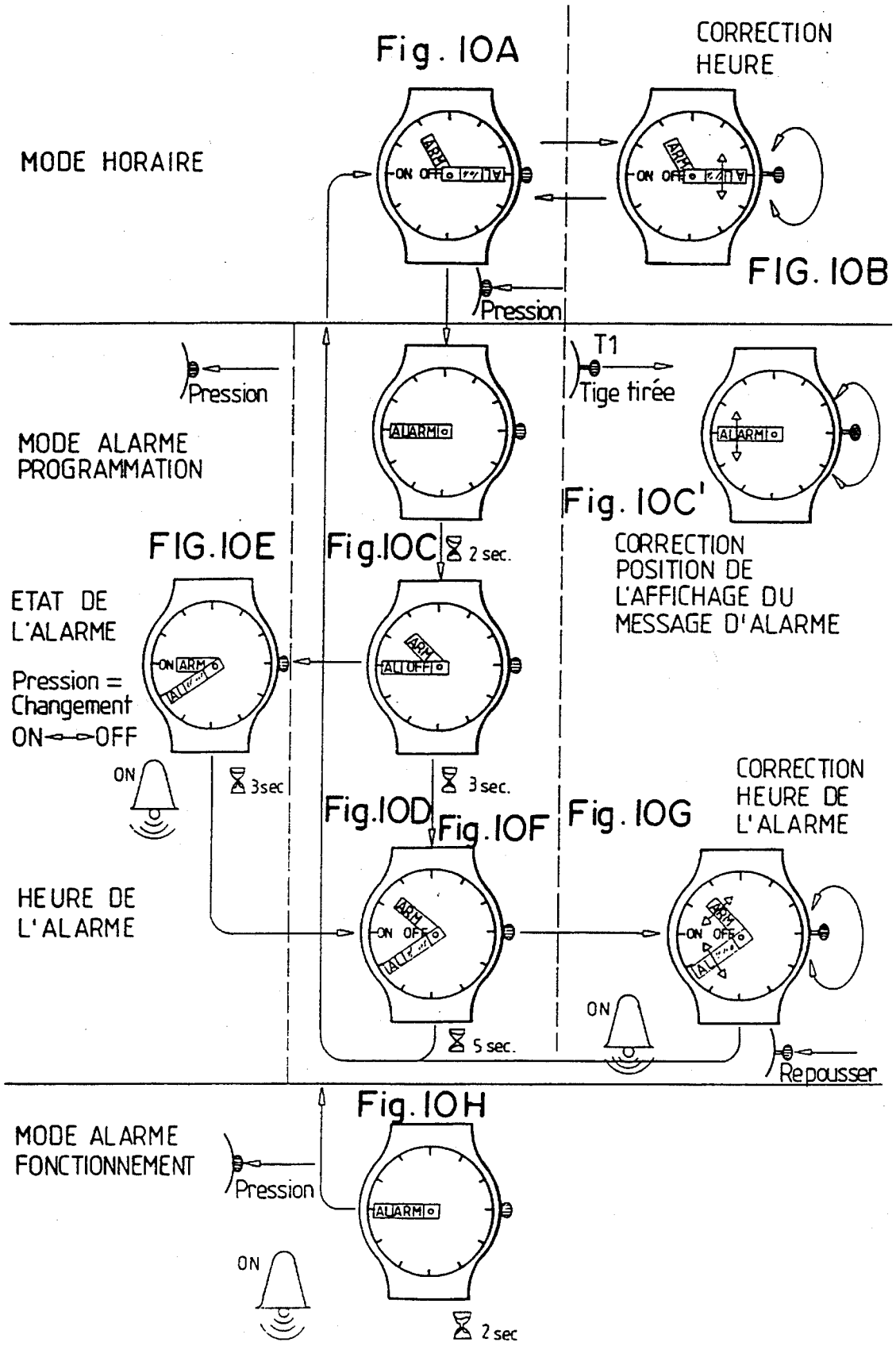
FIG. 10 is a table or flow chart of the different display functions fulfilled by a timepiece according to the invention which comprises the hour and minute hands according to the embodiment of FIG. 8, this timepiece incorporating the block diagram of FIG. 1.

The table or flow chart of FIG. 10 comprises nine drawings or steps (referenced from A to H) each showing different display functions able to be fulfilled by the watch hands according to the invention. The arrows which link the different steps A to H and the few accompanying pieces of information enable understanding of how the control stem is activated to select one of the different display functions, in the different operation modes described.

Time Setting The elements described above enable the time displayed by the hands to be corrected (which corresponds to step B in the table of FIG. 10).

When the watch is in standard time display mode (illustrated by step A), the time correcting function is activated by pulling out the stem. The displacement of the stem outwards causes interpreting circuit 24 (FIG. 1) to transmit a signal to input EN of electronic control means 22. Reception of this signal by electronic control means 22 drives switches 26 and 28 into state b. Simultaneously, electronic control means 22 places a high signal on the reset line of second hand position counter 6 to keep it at zero so that it does not supply the incrementation signal to respectively minute and hour hand position counters 8 and 12.

Interpreting circuit 24 then sends pulses corresponding to the different rotation movements imparted to the stem, by the user, towards inputs $D^+$, $D^-$ of electronic control means 22 which, in turn, transmits control pulses to increment or decrement minute and hour hand position counters 8 and 12 and simultaneously to control motors 18, 20 in order to move the hands. When, after setting the time, the stem is pushed back in, interpreting circuit 24 provides a de-activating signal to electronic control means 22 which in turn provides a signal via its output C to move switches 26, 28 into state a. Simultaneously, the signal on the reset line returns to zero and second hand position counter 6 restarts.

Alarm Mode

As mentioned above, the timepiece described here is intended to have a supplementary function called the alarm function.

To this end, the timepiece includes two counters 27*a* and 29*a* (FIG. 1) to store respectively two (first embodiment) numerical values TAmn and TAh ranging here from 1 to 60, and corresponding respectively to the position of the minute hand and that of the hour hand when they are required to display the alarm time and notably the hour of the alarm. Converted into a time basis, this position corresponds to an alarm time, here for example a time ( event time) programmed by the user, by special procedures which will be explained below.

It is thus clear that counters 27*a* and 29*a* could, according to alternative embodiments which are not shown, register a numerical value representing a non time-related time-scale, for example a day, a month or the combination of both, by using the timepiece shown with one or more counters measuring the days or the months or other time related values.

The timepiece according to the invention also comprises two other counters or registers 31*a* and 33*a* enabling respectively two numerical values PMmn and PMh to be stored, also ranging from 1 to 60 and corresponding respectively to the position of the two hands when they display an alphanumerical message. As will be explained in more detail below, when they are arranged in their display function of one or more messages, the hands are preferably superposed, so that counters 31*a* and 33*a* have the same values PMmn and PMh. In certain of the examples described below, this superposition position is selected at 9 o'clock, so that the two values PMmn and PMh equal 45.

Figure 3:
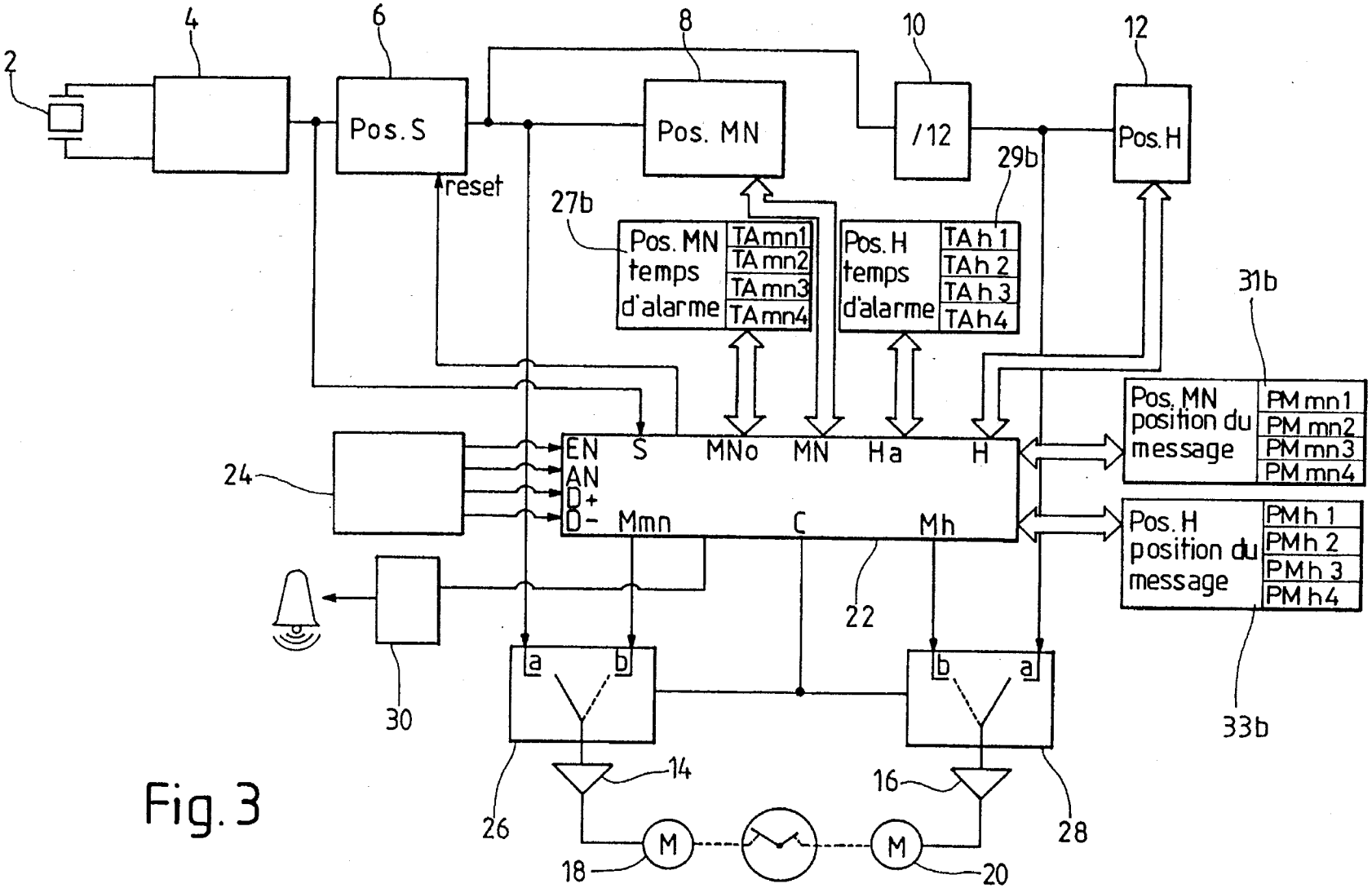
Figure 9A:
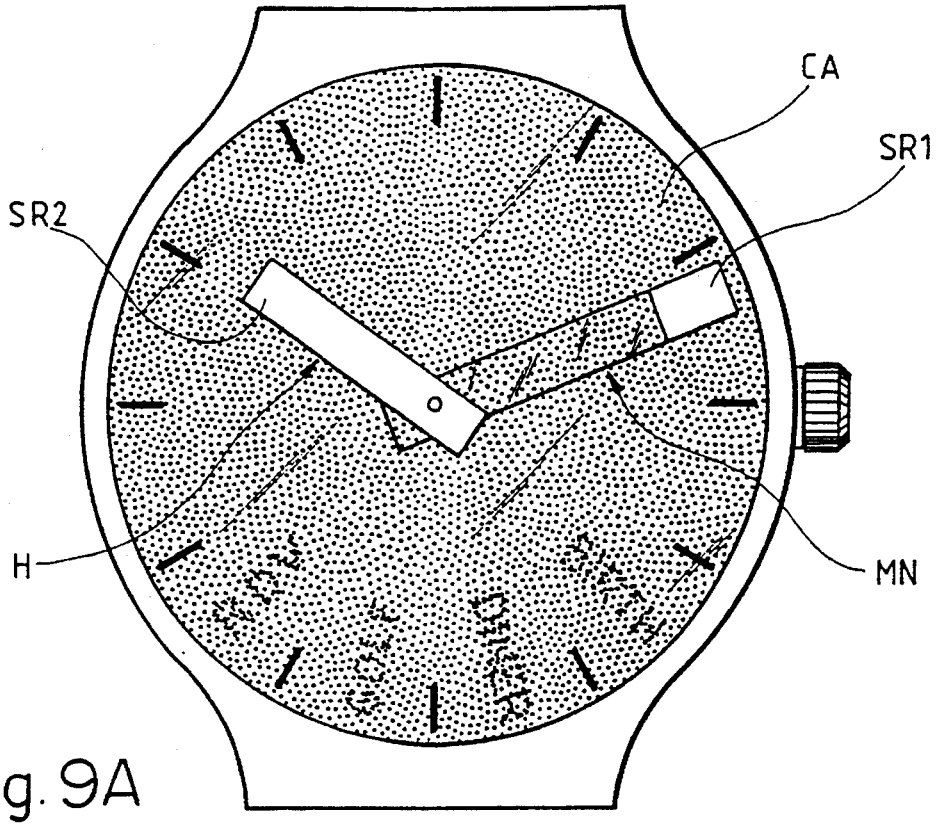
FIG. 9 is a top view of a timepiece according to a further embodiment, incorporating the block diagram of FIG. 2, and shown in two positions (A) and (B) corresponding respectively to any time display position and an alphanumerical message display position amongst several marked on a glass.
Figure 9B:
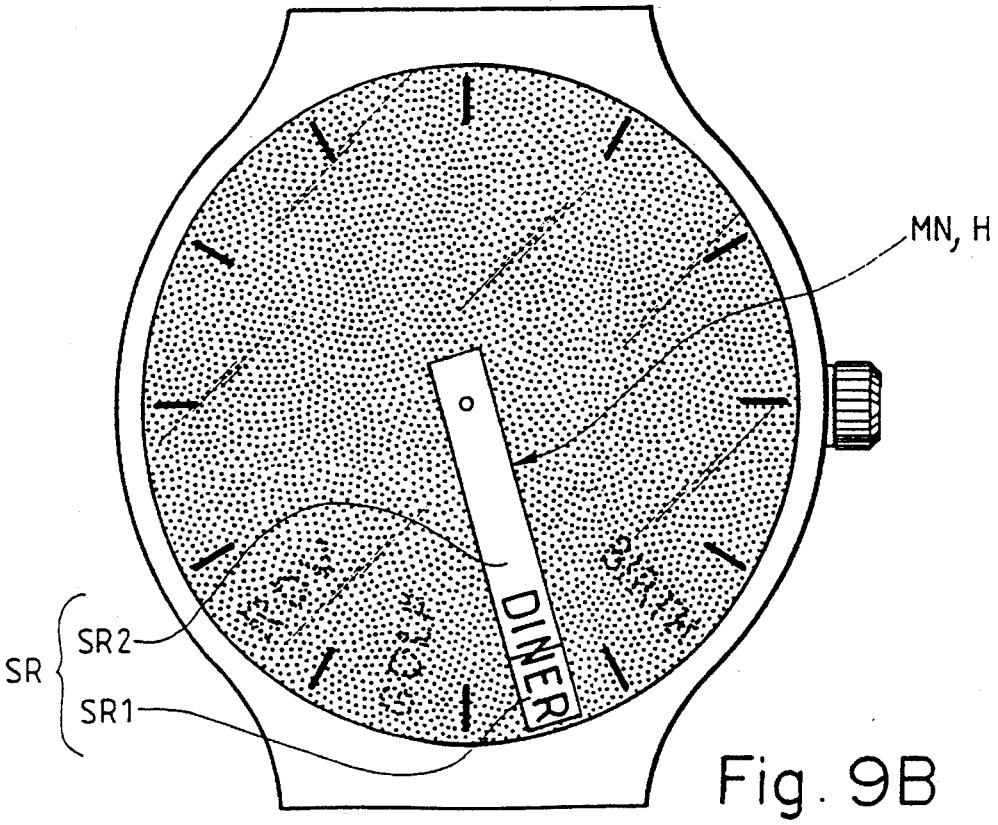

It should be noted here, referring to FIG. 3, that the timepiece according to the invention may comprise counters or registers capable of storing a plurality of data in order to be able to assign different display positions of one or a plurality of messages to the hands as a function of a plurality of alarm times. An embodiment of display means able to display a plurality of messages in different angular positions of the hands in their superposed configuration is shown in FIG. 9.

In the examples shown in FIGS. 1 and 3, the timepiece according to the invention also comprises an acoustic signal synthesiser circuit referenced 30, which is connected to electronic control means 22, this circuit being activated at selected moments when the alphanumerical message is provided to the user.

Referring now to FIGS. 4 to 8, display means called state display means, capable of providing information in the form of the above-mentioned alphanumerical messages will be described, this information relating here to the "alarm" operation mode of this timepiece and/or to the state of a programmed event, linked to the alarm operation mode.

Figure 4A:
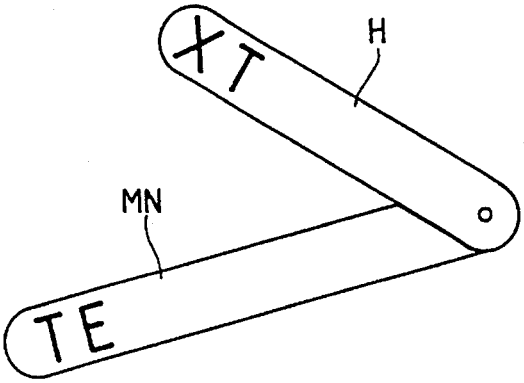
Figure 4B:
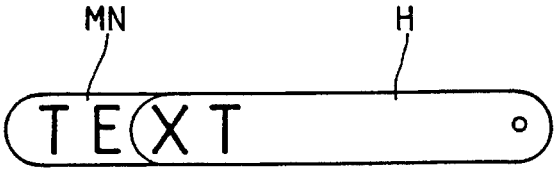

As can be seen in FIG. 4, minute hand MN which is the longest, carries in the proximity of its free end, a first part of a message, here the first two letters T and E of the heading "TEXT", whilst hour hand H, which is the smallest, carries a second part of this message, the last two letters, X and T.

In their position shown in step A, the two time hands H and MN display in the conventional manner time information, in an analogue way, for example 10 hours and 42 minutes, a time which may here be the programmed alarm time (the value TAmn being equal to 42 and the value TAh equal to 48).

In their position shown in step B, the two hands are brought into a superposed position by the action of independent motors 18 and 20, which are driven by electronic control means 22, which in this position reconstitutes the message "TEXT" inscribed on the hands, and provides the message in an intelligible way to the user. Thus, the user is visually reminded of the advent of an event by a clear alphanumerical message.

Figure 5A:
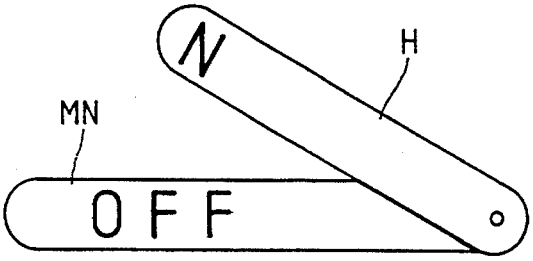
Figure 5B:
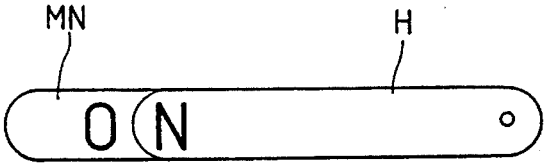

In another embodiment shown in FIG. 5, minute hand MN carries a first message, for example "OFF", which is thus able to be read in any position of said minute hand MN, provided that it is not covered by hour hand H. The angular position of the two hands shown in step A of FIG. 5, also driven by motor means 18 and 20, as are all the positions hereafter described, leaves the heading "OFF" visible. Minute hand MN may thus be brought, in this same relative angular position defined by reference to hour hand H, in front of a mark or indicator (not shown) inscribed on the timepiece. It should be noted here that value PMmn of counter 31*a* (FIG. 1) is equal to 45 and value PMh is equal to 48.

When hour hand H, which carries at its free end the letter N, is brought by control into a superposed position in relation to minute hand MN to overlap it, i.e., over the latter, the shorter hand H masks the letters FF and causes a new intelligible text to appear, for example the heading "ON". Of course, the respective lengths of the two hands and the axial position of the letters inscribed on the latter may be designed to provide the text composition effect which has just been described or any other text and to vary the text as a function of the type of message to be composed.

Figure 6A:
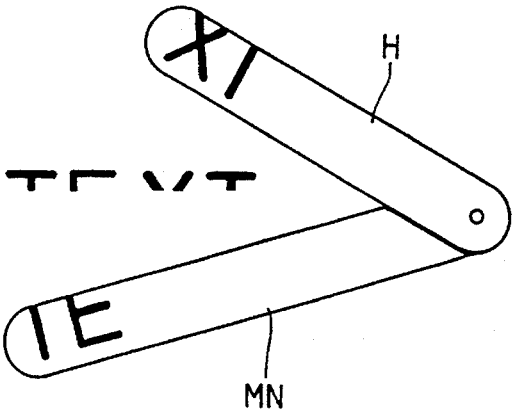
Figure 6B:
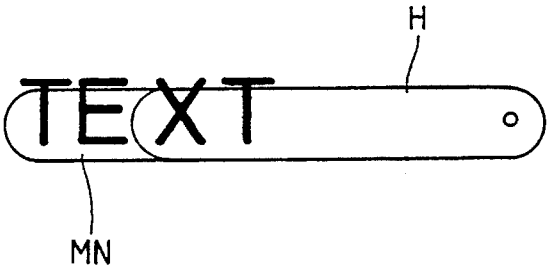

In the third embodiment shown in FIG. 6, the message "TEXT" is divided into two parts, namely a first part formed by the bottom of the four letters split into two groups T,E and X,T inscribed respectively on minute hand MN (group T,E) and hour hand H (group X,T), whilst the second part (top part of all the letters T,E,X and T) is carried by a fixed part of the timepiece, for example the dial (not shown).

Figure 7A:
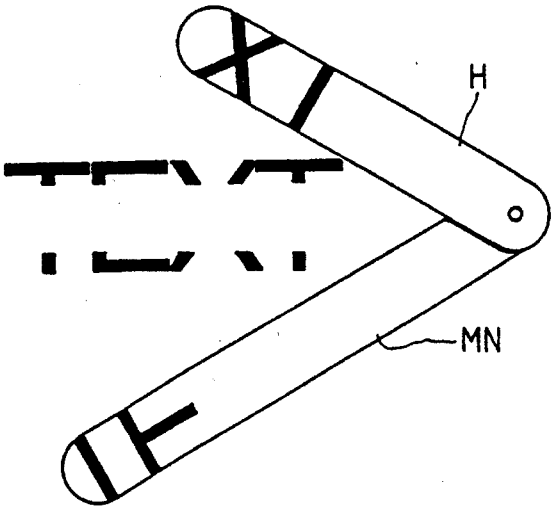
Figure 7B:
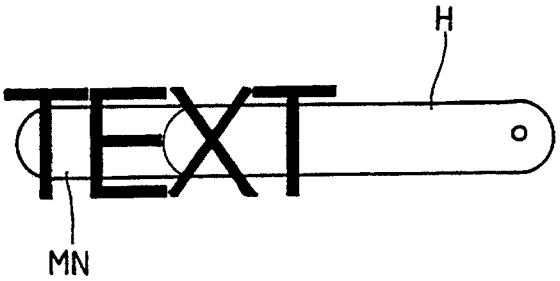
Figure 8A:
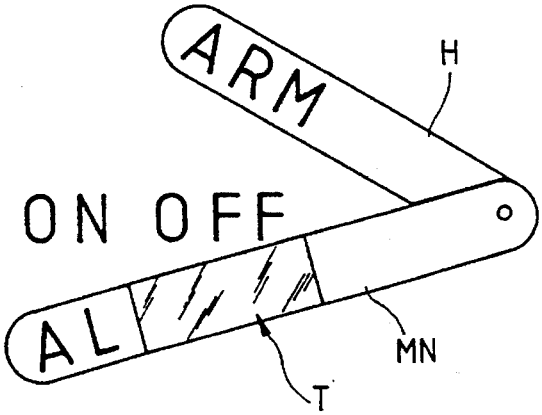
FIG. 8 is also a top view of two hands respectively of the hour and minute, incorporated into a timepiece according to the invention, according to a fifth embodiment, and in which four operation positions of these hands (A to D) are shown corresponding respectively to any time display, -B- to the display of a first alphanumerical message, with masking of two others, -C- to the display of a second alphanumerical message corresponding to a state of the operation mode linked to the first and -D- to the display of a third alphanumerical message informing the user of the change in state of this timepiece.
Figure 8B:
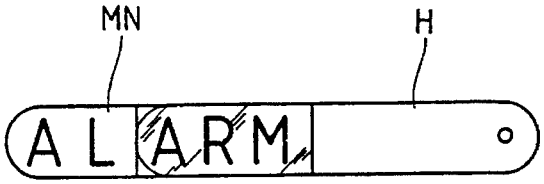
Figure 8C:
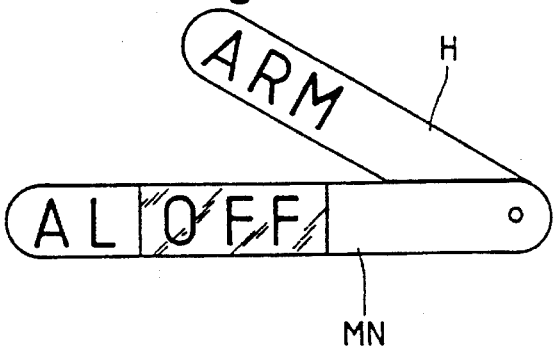
Figure 8D:
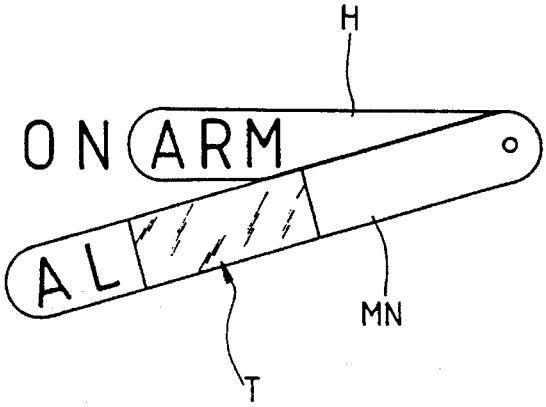

In a fourth embodiment shown in FIG. 7, the alphanumerical message "TEXT" is also truncated vertically, two parts respectively the upper and lower part of the whole message (letters T,E,X and T) being marked on the dial, whilst a complementary part (the middle) of this message is carried by the two hands, upon which are inscribed respectively two groups of characters each formed by two letters of this message.

It should be noted here that this division of letters on the hands may be done with figures (thus with characters in the general sense), the combination of which in a selected reading position of the hands may, by recomposition, lead to the provision of an intelligible message, for the user.

It is also understood that in these embodiments the longest hand (minute hand MN) is mounted underneath the smallest hand (hour hand H).

In the embodiment shown in FIG. 8, the two hands are mounted either one above or below each other on their guiding pipes (not shown).

In the position of step A (time display), no information can be drawn from the two messages "ON" and "OFF" inscribed on the dial, nor from the characters carried by the hands.

It can be seen in this figure that minute hand MN comprises at its free end two characters A and L and in front of the free end of hour hand H, a transparent section T. This section enables the last characters to be displayed, via minute hand MN, in this case letters A,R and M, marked on hour hand H, to reconstitute an intelligible alphanumerical message when the hands are in the superposed position, for example "ALARM", as shown in step B. In this particular superposed position in relation to the dial, the messages of states "ON" and "OFF" are masked by the hands.

If one of hands H or FIN, is staggered at an angle in relation to the other, and is brought into a particular angular position (steps C and D) in relation to the other hand, the two messages "ON" and "OFF", which are marked in a line on the dial in front of the superposition position of the message "ALARM" indicating the operation mode, may be made visible selectively to display one of the states of this operation mode.

It is thus clear from the above description that means for displaying states is provided, formed by the hands themselves which, as a function of their relative angular position driven under the control of electronic control means, may act structurally upon one or a plurality of alphanumerical messages or groups of messages to make them intelligible in selected angular positions of the hands.

It can also be seen that according to these embodiments, the state display means is formed in such a way that the message "TEXT", "ON" (FIG. 5) or "ALARM" which could be a message belonging to a group of alphanumerical messages (FIG. 9), is made intelligible and perceptible when the hands are superposed.

The principles of the alarm operation mode of a timepiece according to the invention, which comprises state display means formed by the hands whose first embodiments are set out above, will be described below.

The user, when he wishes to consult or adjust the alarm time and when he wishes to activate or de-activate the alarm function, must carry out a certain number of manipulations of the control stem, these manipulations being shown in FIG. 10, to which reference will hereafter be made.

Entry into the Alarm Mode

When the watch is in the standard time display mode, and interpreting circuit 24 (FIG. 1) transmits, to input AN of electronic control means 22, an activation signal corresponding to a pressure applied on the stem, electronic control means 22 places a signal at its output C to put switches 26 and 28 into state b (FIG. 1), that is to say to block the pulses coming from counters 8 and 12. Simultaneously, electronic control means 22 reads the contents of counters 8 and 12 in order to know the position of the minute and hour hands. It then transmits the requisite number of pulses to inputs Mmn and Mh to lead the hands to superpose each other in a selected position on the timepiece to enable the indication "ALARM" to be displayed on the dial, as shown in step C of FIG. 10 (this does not affect the operation of counters 6, 8 and 12). This position corresponds to the position of the hands shown in step B of FIGS. 4 to 8. By way of example, if the hands are brought into their superposed state display position, at 9 o'clock on the timepiece, as is the case in FIG. 10 (step C), the electronic control means lead hands H and MN to superpose each other facing the 9 o'clock indicator by transmitting a number of pulses equal to the number of pulses which would be necessary to make the contents of counters 8 and 12 both equal to 45, this value 45 being read by counters or registers 31*a* and 33*a*.

It should be noted here that in the case of the embodiment of state display means shown in FIGS. 4 and 5, the hands can superpose each other in any position in relation to the dial, provided that the characters have been printed in a legible manner.

In the embodiments shown in FIGS. 6, 7 and 8, this superposition must be carried out in a selected position on the timepiece to ensure the exact composition of the message, by causing the truncated parts and the different groups of characters forming this message to coincide.

The alarm mode entry indication by the two hands superposed at 9 o'clock on the dial is thus immediately perceptible to the user to whom a recomposed alphanumerical message appears very clearly. Further, it should be noted that this overlapping hands configuration is unusual in this area of the dial and cannot in any case be confused with a time indication.

Due to the fact that electronic control means 22 have brought the two hands into the position where they provide the alphanumerical text message marked on the latter, the timepiece indicates to the user the entry into the specific operation mode described here, namely the alarm mode. At this moment (step C), the user may change the superposition position if he so desires to programme another message at the same alarm time or at another time, in particular if a plurality of messages are borne by the timepiece, such as is the case in the embodiment shown in FIG. 9, by pulling out the stem and imparting to it a corresponding rotation. Values PMmn and PMh are then modified. In the case of multiple data counters or registers (FIG. 3), each time that this step is repeated each superposition or message display position is registered under a corresponding value, PMmn1, PMmn2 . . . etc, and PMh1, PMh2 . . . etc.

After returning the stem into its pushed in resting position (step C), electronic control means 22 remains in standby mode until it has determined, by counting the 1 Hz pulses issued from division chain 4, that two seconds have elapsed. If these two seconds have elapsed without the control stem having been re-activated, the electronic control means will cause the watch to display the alarm activation state (step D, FIG. 10).

Display and Change of Alarm Activation State

A timepiece with an alarm function always includes means of activating and de-activating the alarm signal. Here the message is acoustic and also visual because, in addition to the ringing, the message is also provided in alphanumerical form to the user. When it is said that a timepiece alarm is activated, this means that the latter will emit a signal called the alarm signal as soon as the time displayed by the hands in standard time display mode coincides with the programmed alarm time. If, on the other hand, the alarm signal is de-activated, no information, either acoustic or visual will be emitted even if the time displayed by the hands coincides with the programmed alarm time. In the present embodiment, it is electronic control means 22 which is set by the user either in a state in which the alarm is activated, or in a state in which it is de-activated.

As specified above, when the watch fulfills the alarm mode entry indication display function (step D, FIG. 10), and two seconds have elapsed without the stem having been activated, electronic control means 22 transmits the requisite number of pulses to inputs Mmn and Mh to cause the hands to move according to selected relative angular positions either to the "ON" position where minute hand MN is displaced to enable this message to appear (step D of FIG. 8), or to the "OFF" position where hour hand H is deplaced to enable this other message to appear (step C of FIG. 8), depending on whether the alarm is activated or de-activated. The position taken by the two hands respectively staggered on the dial, with a reconstituted or unmasked alphanumerical message, provides the user with clear information as to the state of the watch alarm, such information being unable to be confused with a time indication.

When this watch fulfills the alarm activation state display function (step D) which has just been described, the user may change the alarm state simply by applying a pressure to the stem. When interpreting circuit 24 transmits a pulse to electronic control means 22 indicating to the latter that pressure has been applied to the stem, electronic control means 22 transmits the number of pulses necessary to make the corresponding hand or hands move from the position in which they are staggered in relation to each other, into the superposed position or inversely as the case may be (on or off), for each of these two hands.

When following the moment when one of the hands is immobilised in an "ON" or "OFF" display position according to whether the alarm is activated or de-activated, and no pressure has been exerted onto the stem during a period of three seconds, electronic control means 22 control the movement of the hands in order to make them fulfill the pre-programmed alarm time display function, step F (FIG. 10).

Display and Correction of Alarm Time

The respective positions of the minute and hour hands when they indicate the alarm time are stored in alarm time counters 27*a*, 29*a* and 27*b*, 29*b*. In order to display the alarm time, electronic control means 22 will read the contents of counters 27*a*, 29*a* or 27*b*, 29*b* and bring the hands into the positions corresponding to the contents of said counters, by providing to each of the motors a number of pulses equal to the difference between the state of the corresponding alarm time counter, and value PMmn and PMh according to whether the hands were previously in the "ON" message display position or in the "OFF" display position. As soon as the alarm time is displayed, the user has a period of five seconds in which he may pull out the stem to correct the alarm time (step G). Correction of the alarm time is carried out in a similar way to the standard time correction previously described. However, in the present case, it is not hour position counter 12 and minute position counter 8 which are incremented when the hands move, but alarm time counters 27*a*, 29*a* or 27*b*, 29*b*. Once correction of the alarm time is completed, the user pushes the stem back in. When the stem is pushed back in interpreting circuit 24 sends to electronic control means 22 a signal which has two functions, its first function being to activate the alarm, so that an alarm signal is emitted as soon as the hour and minute hand position counters coincide with the alarm time counters. The second function of the signal is to cause electronic control means 22 to bring the hands into the standard time display mode, step A, electronic control means 22 calculating the number of pulses necessary to carry out this operation by comparing the contents of hand position counters 8 and 12 with the alarm time counters 27*a*, 29*a* or 27*b*, 29*b*.

It should be noted that in the case of multiple data counters or registers, such as those (27*b*, 29*b*) shown in FIG. 3, the programming operation may be repeated to register and activate all or a plurality of the alarm times in each case with different alarm positions stored in the counters or registers 31*b*, 33*b*. At the time of the repeated sequences of steps C to G, values TAmn1, TAmn2, . . . etc, TAh1, TAh2 . . . etc, and PMh1, PMh2 . . . etc are registered. This procedure is carried out in conjunction with the embodiment of the state display means shown in FIG. 9.

As is seen in FIG. 9, the timepiece according to the invention comprises in this example a dial CA of, for example, a dark colour, whilst the glass (not referenced) comprises alphanumerical messages inscribed on the latter in the same colour as the dial. Consequently, the alphanumerical messages, for example RDV (meeting), GOLF, DINER, BIRTH (birthday) barely appear or do not appear at all in the time display position (step A). Further, the free end of the longest hand (minute hand MN) carries a first part of a reflective surface SR1, the rest of this hand being transparent. Surface SR1 is formed of a size such that when it passes under one of the messages inscribed on the glass, the messages appear only partially and are thus unintelligible to the user. The upper surface SR2 of the hour hand is completely reflective.

Thus, when the two hands MN and H are superposed the total visible surface which they form (step B) by their superposition, in this configuration alone, forms a display surface SR capable of reflecting light to make visible at least one of the messages carried above the hands by the fixed element which is the glass.

It will be noted that the various messages are inscribed on the glass in different angular positions from those where the hands overlap each other during the usual display of the time display mode. It is understood that the different embodiments of the invention which have just been described with the display of one or more alphanumerical messages by means of the hands being held in a particular relative angular position, does not entail any power consumption, because in this blocked position the motors are kept in rotation by their intrinsic magnetic positioning couple. The message remains permanently with, possibly, the emission of an acoustic signal until the user has indicated receipt of the message, for example by a pressure on the stem.

Alarm and Interruption of the Alarm

When the timepiece according to the invention is in standard time display mode A and the alarm has been activated, an alphanumerical message and, possibly, an acoustic signal are, as already noted, emitted as soon as the contents of one of the values of the hand position counters 8, 12 corresponds to the contents of one of the values of the alarm time counters 27*a*, 29*a* and 27*b*, 29*b*. At this moment, control means 22 (FIGS. 1 and 3) , as previously described, brings the hands to the alphanumerical message display (position) (step H, FIG. 10 and step B, FIGS. 4 to 9) until the user interrupts the emission of the alarm signal by applying a pressure to the stem. The pressure exerted on the stem causes interpreting circuit 24 to transmit a signal to electronic control means 22 on the one hand to interrupt the signal, and on the other hand to de-activate the alarm, which thus, in the absence of a further manipulation by the user, will not emit any signal at the next coincidence between the contents of the hand position counters 8, 12 and the alarm time counters twelve hours later.

What is claimed is:

1. An analogue display timepiece having a time display mode, and at least one other operation mode for displaying information relating to a state of said other mode and/or to the state of a programmed event linked to said other mode, said timepiece comprising:

at least two analogue display organs comprising respectively, an hour hand and a minute hand capable of being activated independently by motor means, electronic control means for controlling said other mode, and state display means for providing a user of the timepiece with at least one alphanumerical message informing the user of the state of said other mode and/or the state of said event, said state display means comprising the hands themselves which, as a function of their relative angular position driven under the control of the electronic control means, are arranged to act structurally upon said message to make it intelligible in a selected angular position of the hands.

2. A timepiece according to claim 1, wherein said state display means is formed in such a way that said message is made intelligible and perceptible essentially when the hands are superposed.

3. A timepiece according to claim 1, wherein the two hands carry respectively a part of the message which can only be reconstituted in the selected angular position of the hands, this position being driven under the control of the electronic control means as a function of the state of said mode and/or said event.

4. A timepiece according to claim 3, wherein said message is integrally and uniquely inscribed on the hands, partly on one and partly on the other, said message only being able to be reconstituted when said hands are superposed.

5. A timepiece according to claim 1, wherein said message is inscribed in part on at least one of the hands and in part on a fixed element of the timepiece.

6. A timepiece according to claim 3, wherein said message is inscribed in part on said hands and in part on a fixed element of the timepiece.

7. A timepiece according to claim 5, wherein the fixed element is formed by the dial and/or the glass.

8. A timepiece according to claim 5, wherein said message is truncated vertically, a lower part and/or an upper part of the latter being carried by said fixed part, whilst its complementary part is carried by the hand or hands.

9. A timepiece according to claim 1, wherein the longest hand is mounted under the smallest hand.

10. A timepiece according to claim 1, wherein the hands are formed in such a way that, when they are superposed, the total visible surface constituted by their superposition forms only in this configuration a display surface capable of reflecting light to make visible at least one message carried above the hands by a fixed element of the timepiece.

11. A timepiece according to claim 10, wherein the fixed element is the glass.

12. A timepiece according to claim 11, wherein said glass carries a plurality of messages above which the hands can be superposed, by the selective control of the electronic control means.

13. A timepiece according to claim 12, wherein the various messages are inscribed on the glass in different angular positions to those in which the hands overlap during the standard display operation mode.

14. A timepiece according to claim 2, wherein the two hands carry respectively a part of the message which can only be reconstituted in the selected angular position of the hands, this position being driven under the control of the electronic control means as a function of the state of said other mode and/or said event.

15. A timepiece according to claim 14, wherein said message is integrally and uniquely inscribed on the hands, partly on one and partly on the other, this message only being able to be reconstituted when said hands are superposed.

16. A timepiece according to claim 2, wherein said message is inscribed in part on at least one of the hands and in part on a fixed element of the timepiece.

17. A timepiece according to claim 6, wherein the fixed element is formed by the dial and/or the glass.

18. A timepiece according to claim 6, wherein said message is truncated vertically, a lower part and/or an upper part of the latter being carried by said fixed part, whilst its complementary part is carried by the hand or hands.

19. A timepiece according to claim 1, wherein the hands are formed in such a way that, when they are superposed, the total visible surface constituted by their superposition forms only in this configuration a display surface capable of reflecting light to make visible at least one message carried above the hands by a fixed element of the timepiece.

20. A timepiece according to claim 2, wherein the hands are formed in such a way that, when they are superposed, the total visible surface constituted by their superposition forms only in this configuration a display surface capable of reflecting light to make visible at least one message carried above the hands by a fixed element of the timepiece.

* * * * *